US007415972B2

(12) United States Patent
Ogawa

(10) Patent No.: US 7,415,972 B2
(45) Date of Patent: Aug. 26, 2008

(54) FUEL INJECTION APPARATUS FOR ENGINES

(75) Inventor: Hisao Ogawa, Kanagawa-ken (JP)

(73) Assignee: Mitsubishi Heavy Industries, Ltd., Kanagawa-ken (JP)

( * ) Notice: Subject to any disclaimer, the term of this patent is extended or adjusted under 35 U.S.C. 154(b) by 0 days.

(21) Appl. No.: 11/812,161

(22) Filed: Jun. 15, 2007

(65) Prior Publication Data

US 2008/0105235 A1 May 8, 2008

(30) Foreign Application Priority Data

Nov. 2, 2006 (JP) ..... 2006-299641

(51) Int. Cl.
*F02M 37/06* (2006.01)
*F02M 37/04* (2006.01)

(52) U.S. Cl. ..... 123/495; 123/456

(58) Field of Classification Search ..... 123/456, 123/446, 495, 508, 515; 417/531, 521, 533
See application file for complete search history.

(56) References Cited

U.S. PATENT DOCUMENTS 4,459,963 A * 7/1984 Gross et al. ..... 123/506
5,133,645 A * 7/1992 Crowley et al. ..... 417/279
5,197,438 A * 3/1993 Kumano et al. ..... 123/506
5,230,613 A * 7/1993 Hilsbos et al. ..... 417/439
5,277,156 A * 1/1994 Osuka et al. ..... 123/198 DB
5,404,855 A * 4/1995 Yen et al. ..... 123/446
5,538,403 A * 7/1996 Black ..... 417/253
6,755,625 B2 * 6/2004 Breeden ..... 417/298
7,179,060 B2 * 2/2007 Sommars et al. ..... 417/53
2004/0109768 A1 * 6/2004 Sommars et al. ..... 417/307

FOREIGN PATENT DOCUMENTS

JP 64-073166 3/1989
JP 07-217515 8/1995

* cited by examiner

*Primary Examiner*—Mahmoud Gimie
(74) *Attorney, Agent, or Firm*—Wenderoth, Lind & Ponack, L.L.P.

(57) ABSTRACT

A fuel injection apparatus having a plurality of high pressure fuel injection pumps for supplying fuel to a common rail, of which amounts of fuel discharge can be controlled by a fuel supply amount adjusting device of simple and reliable construction. The fuel supply amount adjusting device is provided to fuel feed passages for feeding fuel to the plunger rooms. The adjusting device includes a spool valve device for varying opening area of each of passages for introducing fuel into each of the plunger rooms by sliding a spool fitted slidably in a spool valve case, a spool drive device for sliding the spool, and a controller for controlling the spool drive device so that the spool is slid to a position at which the opening area coincide with area required depending on engine operating conditions.

4 Claims, 2 Drawing Sheets

FUEL INJECTION APPARATUS FOR ENGINES

BACKGROUND OF THE INVENTION

1. Field of the Invention

The present invention relates to a fuel injection apparatus and applied to a diesel engine, etc. equipped with an accumulator fuel injection apparatus, the apparatus being composed such that high pressure fuel pumps are provided each of which compresses fuel introduced into a plunger room to high pressure by a plunger fitted in a plunger barrel and reciprocated by means of a fuel cam to supply the compressed fuel to a common rail, and the high pressure fuel accumulated in the common rail is injected periodically at determined injection timing into each of the cylinders of the engine.

2. Description of the Related Art

An accumulator fuel injection equipment used in a diesel engine is provided with a plurality of high pressure fuel injection pumps each of which compresses fuel introduced into a plunger room to high pressure by a plunger fitted in a plunger barrel and reciprocated by means of a fuel cam. The high pressure fuel accumulated in a common rail is supplied to each of fuel injection valves to be injected periodically at determined injection timing into each engine cylinder.

In an accumulator fuel injection apparatus for the diesel engine like this, discharge duration of high pressure fuel from each of the high pressure fuel pumps is controlled by controlling opening/closing of a low pressure side fuel feed passage by means of an electromagnetic valve provided to each of the high pressure fuel pumps as disclosed for example in Japanese Laid-Open Patent Application No. 64-73166 (patent literature 1) and Japanese Laid-Open Patent Application No. 7-217515 (patent literature 2).

According to the art disclosed in the patent literature 1, fuel introduced into a plunger room of each of a plurality of high pressure fuel pumps is compressed to high pressure by a plunger and supplied to a common rail by closing a fuel feed passage to the plunger room by an electromagnetic valve while the plunger is in the up stroke. The electromagnetic valve is then opened when the plunger moved up near to its top dead center and fuel is introduced in the plunger room as the plunger moves down.

The patent literature 2 relates to improvement of the electromagnetic valve of the high pressure fuel pump, in which the electromagnetic valve is increased in responsivity by making it possible to reduce spring force to retain valve body opened; by allowing force to be reduced which exerts on the valve body in direction to close the valve when fuel-back flows through the valve.

In the prior art disclosed in the patent literature noted above, an electromagnetic valve is provided for each of high pressure fuel pumps for pressure feeding fuel to a common rail, and fuel introduced in the plunger room of high pressure fuel pump is compressed to high pressure and discharged to the common rail by closing each electromagnetic valve by a signal form a controller, or high pressure fuel remaining in the plunger room is spilled to a fuel feed passage side by opening the electromagnetic valves by a signal from the controller.

Therefore, as an electromagnetic valve is provided for each of the high pressure fuel pumps and a controller for controlling the electromagnetic valve is provided, devices for controlling fuel discharge and spill become complicated requiring a number of parts and resulting in increased cost. Further, the likelihood of occurrence of a malfunction in the electronic components of the electromagnetic valves and electronic controller for controlling fuel discharge or introduction is higher as compared with a mechanical control device.

Furthermore, as control of fuel discharge and spill is done by electromagnetic valves provided for each of the fuel pumps and a controller in the prior arts, time retard inevitably occurs from the time of detection of engine operation conditions to the time to actuate the electromagnetic valve by means of the controller when starting the engine. Thus, the period of starting the engine may be increased resulting in deteriorated engine startability.

SUMMARY OF THE INVENTION

The present invention addresses the problems mentioned above, and the object of the invention is to provide a fuel injection apparatus for engines, wherein discharge amounts of fuel supplied to a common rail from a plurality of high pressure fuel pumps can be controlled by a fuel supply amount adjusting device which is simple in construction, small in number of constituent parts, low in manufacturing cost, small in degree of likelihood of occurring malfunction, superior in maintenability, and further improved in facility of engine starting without time lag in actuating the device when starting the engines. The apparatus of the present invention comprising a plurality of high pressure fuel pumps for supplying high pressure fuel to a common rail by compressing fuel introduced in each of plunger rooms of the pumps by each of plungers reciprocated by means of each of fuel cams. The high pressure fuel accumulated in the common rail is injected into each of a plurality of engine cylinders at controlled injection timing, wherein a fuel supply amount adjusting device is provided to fuel feed passages for feeding fuel to the plunger rooms. The adjusting device comprising (i) a spool valve device for varying opening area of each of passages for introducing fuel into each of the plunger rooms by sliding a spool fitted slidably in a spool valve case, (ii) a spool drive device for sliding the spool, and (iii) a controller for controlling the spool drive device so that the spool is slid to a position at which the opening area coincide with an area required depending on engine operating condition.

In the invention, it is preferable that the spool valve device is composed such that the spool has control ports arranged along sliding direction thereof to be communicated with each of the fuel feed passages so that overlapping area of the control ports with the fuel feed passages can be varied by sliding the spool.

According to the invention, a spool valve device is provided which has a spool having control ports corresponding to each of the fuel feed passages for controlling opening area of each of the fuel supply passages for feeding fuel to each of the plunger rooms. The spool is fitted slidably in the spool valve case and the opening area is controlled by sliding the spool. The opening area (overlapping area of the control port with the fuel feed passage) is controlled by the controller such that the opening area coincides with an area in accordance with engine operating conditions among areas defined beforehand for various engine operating conditions. Therefore, control of discharge amounts of fuel from a plurality of high pressure pumps can be achieved by providing a combination of the spool valve device having the spool slidable in the spool valve case and the controller for controlling so that the spool is slid to an appropriate position depending on engine operating condition; the combination being able to be composed of smaller number of constituent parts, to be extremely simpler in composition, and lower in cost as compared with prior art in which a plurality of electromagnetic valves and a controller are required to be provided for controlling discharge amounts of fuel to be supplied to the common rail.

Further, since means for controlling discharge amounts of the high pressure fuel pumps is a combination of a mechanical device of spool valve device and a controller of simple function, the degree of likelihood of occurring malfunctions is small as compared with similar prior art control devices which typically include a combination of a plurality of electromagnetic valves and a controller for controlling the valves.

Furthermore, when starting the engine, the spool valve device can be actuated by nearly proportional control by the controller of simple function as soon as an engine start directive is received by the controller without time lag, so responsivity of valve control when starting the engine is higher than the combination of electromagnetic valves and controller of prior art, and facility of engine starting can be improved.

It is preferable that each of the control ports of the spool has a diameter the same of that of the fuel feed passages.

By this, opening area of each of the fuel feed passages, that is, overlapping area of the control port with the fuel feed passage can be controlled to be the same as each other at the same time by sliding the spool having a plurality of control ports corresponding to a plurality of fuel feed passages, and fuel discharge amount of each of the high pressure pumps can be evened.

It is also preferable that the control ports of the spool include elongate ports of widths of the diameter of the fuel feed passages perpendicular to the sliding direction and length of an integral multiple of the diameter of the fuel feed passages along the sliding direction.

By this, the fuel feed pump side fuel feed passages can be communicated or discommunicated with the plunger room side inlet passages by the control ports by sliding the spool. That is, some of the fuel feed passages are discommunicated and others are communicated. Thus, it becomes possible to allow the high pressure fuel pumps to work selectively to supply fuel to the common rail with other pump or pumps kept inoperative concerning fuel supply to the common rail by a very simple means.

In the invention, it is preferable that the controller allows the spool drive device to actuate the spool valve device so that the opening area of the fuel feed passages is increased or decreased as engine load is increased or decreased.

By this, fuel discharge amount of the high pressure fuel pumps can be increased or decreased according as engine loads is increased or decreased by the spool valve device of simple construction which varies the opening area, i.e. overlapping area of the inlet passage to the plunger room with the fuel feed passage for feeding fuel from the fuel feed pump.

DETAILED DESCRIPTION OF THE INVENTION

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only and not meant to be limitative of the scope of the present invention.

Figure 1:
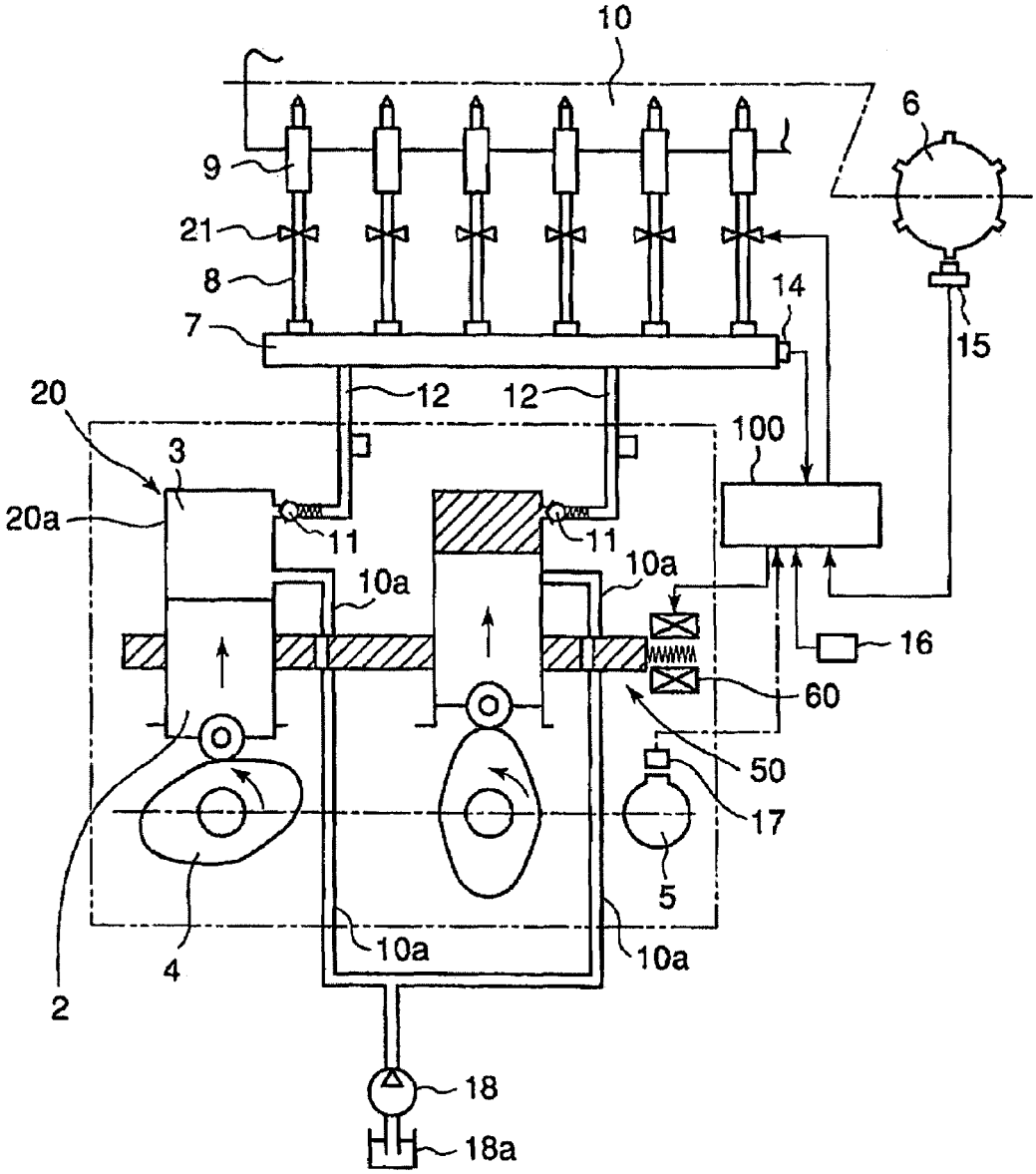
FIG. 1 is a schematic representation of over-all configuration of the accumulation fuel injection apparatus according to the invention for diesel engines.

FIG. 1 is a schematic representation of over-all configuration of the accumulation fuel injection apparatus according to the invention for diesel engines.

Referring to FIG. 1, the accumulation fuel injection apparatus is provided with a plurality of high pressure fuel pumps 20 (two pumps in this example). Each of the high pressure fuel pumps 20 has a plunger 2 fitted in a plunger barrel 20*a* for reciprocation. The plunger 2 is reciprocated in the plunger barrel 20*a* by means of a fuel cam 4 of a camshaft 5 to compress fuel introduced into a plunger room 3. A discharge pipe 12 connects the plunger room 3 to a common rail 7, and a check valve 11 is provided at an exit of the plunger room 3 to the discharge pipe 12 so that fuel can flow only in direction from the plunger room 3 to the common rail 7.

Fuel is supplied to the plunger room 3 from a fuel feed pump 18 via a fuel feed passage 1*a* and a spool valve device 50 which opens and closes between the fuel feed passage 10*a* and the plunger room 3 as explained later. High pressure fuel supplied from the high pressure fuel pumps 20 to the common rail 7 and accumulated in the common rail 7 is supplied to fuel injection valves 9 provided to each of engine cylinders 10 to be injected into each of the cylinders 10.

Controlling each of fuel control valves 21 by a controller 100 controls fuel injection timing and quantity of the fuel injection valves 9.

Pressure filling of fuel from the plunger room 3 to the common rail 7 begins when the plunger 2 is moved up by the fuel cam 4 and closes the fuel feed passage 10*a*. Fuel in the plunger room 3 is compressed by the up stroke of the plunger 2 and supplied to the common rail 7 to be accumulated therein. Fuel accumulated in the common rail 7 is injected into each of the engine cylinders 10 by each of the injection valve 9 at controlled injection timing.

To the controller 100, rotation angles of the crankshaft 5 (crank angles) detected by a crank angle sensor 1*s*, engine loads detected by a load detector 16, rotation speed of the camshaft 5 detected by a cam rotation speed detector 17, and common rail pressure (fuel pressure in the common rail 7) detected by a common rail pressure sensor 14 are inputted.

The controller 100 outputs a signal for controlling timing of opening and closing the fuel feed passage by the spool valve device 50 to a spool drive device 60 which is composed of an electromagnetic actuator for driving the spool valve device 50, based on the detected values. The controller 100 has also a function for controlling fuel injection timing and quantity of the fuel injection valves 9 by controlling the fuel control valves 21 based on the detected valves.

Figure 2:
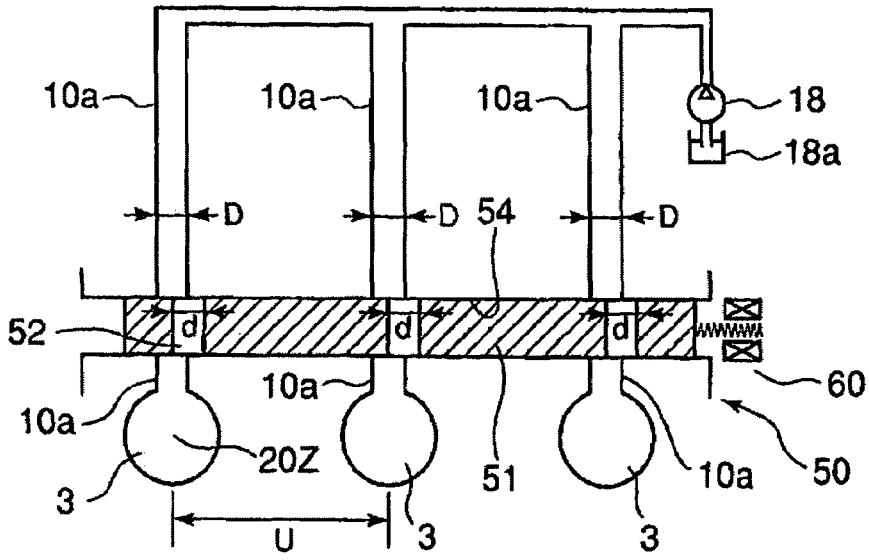
FIG. 2 is a plan view showing schematically a first embodiment of the spool valve device used in the apparatus.

FIG. 2 is a schematic plan view of a first embodiment of the spool valve device 50. In FIG. 2, three high pressure fuel pumps are provided as an example.

Referring to FIG. 2, the spool valve device 50 for controlling amounts of fuel fed to the plunger room 3 includes a spool 51 fitted slidably in a spool valve case 54. The spool 51 has control ports 52 positioned at spacing the same as that of the center distance U of the centers 20Z of the plunger rooms 3.

In the embodiment, each of the control ports 52 has a diameter of d the same as a diameter D of each of the fuel feed passages 10*a*. Opening area of the fuel feed passage 10*a* at the inlet to the plunger room 3, the opening area being an overlapping area of the control port 52 with the fuel feed passage 10*a*, can be varied by sliding the spool 51.

The spool valve device 50 has a spool drive device 60 connected to an end of the spool 51 for sliding the spool 51.

The spool drive device 60 slides the spool 51 upon receiving the control signal from the controller 100 so that the opening area of the fuel feed passage 10*a*, particularly the plunger room side inlet passage 10*a* coincides with an area in accordance with engine operating condition among areas defined beforehand for various engine operating conditions.

With this construction, opening area of each of the plunger room side fuel feed passages 10*a* can be controlled to be the same to each other at the same time by sliding the spool 51, and fuel discharge amounts from the high pressure fuel pump 20 to the common rail 7 is evened.

The controller 100 controls the spool drive device 60 to actuate the spool valve device 50 so that opening area of the plunger room side fuel feed passage 10*a* is increased or decreased with increased or decreased engine load. That is, the controller 100 allows the spool drive device 60 to slide the spool 51 to increase opening area of the fuel feed passage 10*a* when the engine load is increased and decrease opening area of the fuel feed passage loa when the engine load is decreased.

By composing like this, opening area of each of the fuel feed passages can be varied by a simple means of the spool valve device 50 to vary amounts of discharge of fuel from the high pressure fuel pump 20 depending on engine loads.

Figure 3:
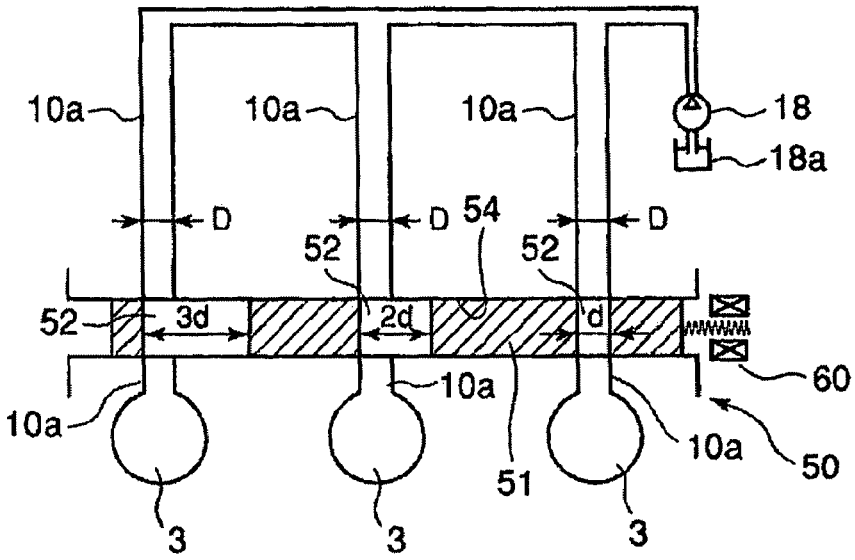
FIG. 3 is a plan view showing schematically a second embodiment of the spool valve device used in the apparatus.

FIG. 3 is a schematic plan view of a second embodiment of the spool valve device 50. In FIG. 3, three high pressure fuel pumps are provided as an example.

In the second embodiment, the spool 51 of the spool valve device 50 has three control ports 52 different in port area from each other. Concretively, a first control port is a circular port of diameter of d which is the same to the diameter D of the fuel feed passage 10*a*, a second control port is of an elongate port of width of d and length of 2*d*, and a third control port is an elongate port of width of d and length of 3*d*. Thus, a reference port has a diameter of d and other ports are formed to be of elongate ports of width of d and length multiplied by integers increasing sequentially from integer number 2.

By composing like this, the fuel feed pump side fuel feed passages can be communicated or discommunicated with the plunger room side inlet passages by the control ports by sliding the spool 51. That is, some of the fuel feed passages are discommunicated and others are communicated. For example, in the example of FIG. 3, it is possible that one of the fuel feed passages is closed by the spool and other two passages are communicated with corresponding plunger rooms, that two of the fuel feed passages are closed by the spool and remaining one is communicated with the corresponding plunger room. Thus, it becomes possible to allow the high pressure fuel pumps to work selectively to supply fuel to the common rail with other pump or pumps kept inoperative concerning fuel supply to the common rail by a very simple means.

Construction other than that is the same as that of the first embodiment, and the same component parts are denoted by the same reference numerals.

According to the embodiment, a spool valve device 50 is provided with a spool 51 having control ports 52 corresponding to each of the fuel feed passages for controlling opening area of each of the fuel supply passages 10*a* for feeding fuel to each of the plunger rooms 3, the spool 51 being fitted slidably in the spool valve case 54 and the opening area control being done by sliding the spool 51; and opening area (overlapping area of the control port 52 with the fuel feed passage boa) is controlled by the controller 100 such that the opening area coincides with required area defined beforehand depending on engine operating conditions. Therefore, control of amounts of fuel discharged from a plurality of high pressure pumps 20 can be achieved by providing a combination of the spool valve device 50 having the spool 51 slidable in the spool valve case 54 and the controller 100 for controlling so that the spool 51 is slid to an appropriate position depending on engine operating conditions. The combination being able to be composed of smaller number of constituent parts, to be extremely simpler in composition and lower in cost as compared with prior art in which a plurality of electromagnetic valves and a controller are required to be provided for controlling discharge amounts of fuel to be supplied to the common rail.

Further, since the means for controlling discharge amount of the high pressure fuel pumps 20 is a combination of a mechanical device of spool valve device 50 and a controller of simple function, degree of likelihood of occurring malfunction is small as compared with control means of prior art which is a combination of a plurality of electromagnetic valves and a controller for controlling the valves, and stable controlling is made possible.

Furthermore, when starting the engine, the spool valve device 50 can be actuated by nearly proportional control by the controller 100 of simple function as soon as an engine start directive is received by the controller without time lag, so responsivity of valve control when starting the engine is higher than the combination of electromagnetic valves and controller of prior art, and facility of engine starting can be improved.

As has been described heretofore, according to the invention, discharge amounts of a plurality of high pressure fuel pumps can be controlled by a combination of a spool valve device having a spool fitted slidably in a spool valve case and a controller for controlling only slide position of the spool in accordance with engine operating conditions, so the combination can be composed of smaller number of constituent parts and lower in cost as compared with the combination of prior art which includes a plurality of electromagnetic valves and a controller for controlling the electromagnetic valves.

Further, discharge amount of a plurality of the high pressure pumps can be controlled by the combination of a mechanical device of spool valve device and a controller of simple function, degree of likelihood of occurring malfunction is small as compared with control means of prior art which is a combination of a plurality of electromagnetic valves and a controller for controlling the valves, and stable controlling is made possible.

Furthermore, when starting the engine, the spool valve device can be actuated by nearly proportional control by the controller of simple function as soon as an engine start directive is received by the controller without time lag, so responsivity of valve control when starting the engine is higher than the combination of electromagnetic valves and controller of prior art, and facility of engine starting can be improved.

The invention claimed is:

1. A fuel injection apparatus for engines, the apparatus comprising:

a plurality of high pressure fuel pumps that supply high pressure fuel to a common rail by compressing fuel introduced in each of a plurality of plunger rooms of the plurality of high pressure fuel pumps by each respective plunger reciprocated by respective fuel cams, the high pressure fuel accumulated in the common rail being injected into each of a plurality of engine cylinders at a controlled injection timing; and a fuel supply amount adjusting device that provides fuel feed passages for feeding fuel to the plurality of plunger rooms, said fuel supply amount adjusting device including (i) a spool valve device that varies an opening area of each of the fuel feed passages for introducing fuel into each of the plurality of plunger rooms by sliding a spool fitted slidably in a spool valve case, (ii) a spool drive device having an electromagnetic actuator that slides the spool, and (iii) a controller that controls the spool drive device to actuate the spool valve device so that the opening area of the fuel feed passages is increased or decreased based on changes in engine load.

2. A fuel injection apparatus as claimed in claim 1, wherein said the spool valve device is configured such that the spool has control ports arranged along a sliding direction thereof to be communicated with each of the fuel feed passages so that overlapping area of the control ports with the fuel feed passages is varied by sliding the spool.

3. A fuel injection apparatus as claimed in claim 2, wherein each of the control ports of the spool has a diameter the same as the fuel feed passages.

4. A fuel injection apparatus as claimed in claim 2, wherein the control ports of the spool include elongate ports of a width equal to the diameter of the fuel feed passages and perpendicular to the sliding direction, and a length of an integral multiple of the diameter of the fuel feed passages along the sliding direction.

* * * * *